US010125564B2

(12) United States Patent
Cenac

(10) Patent No.: US 10,125,564 B2
(45) Date of Patent: Nov. 13, 2018

(54) ACCUMULATOR SYSTEM FOR USE WITH COILED TUBING AND WIRELINING OPERATIONS

(71) Applicant: Timothy Cenac, Bourg, LA (US)

(72) Inventor: Timothy Cenac, Bourg, LA (US)

( * ) Notice: Subject to any disclaimer, the term of this patent is extended or adjusted under 35 U.S.C. 154(b) by 173 days.

(21) Appl. No.: 14/998,585

(22) Filed: Jan. 27, 2016

(65) Prior Publication Data

US 2016/0237788 A1 Aug. 18, 2016

Related U.S. Application Data

(60) Provisional application No. 62/125,487, filed on Jan. 23, 2015.

(51) Int. Cl.

| | |
|---|---|
| ***F15B 1/00*** | (2006.01) |
| ***E21B 33/06*** | (2006.01) |
| *F15B 1/02* | (2006.01) |

(52) U.S. Cl.

CPC ..... *E21B 33/06* (2013.01); *F15B 1/00* (2013.01); *F15B 1/024* (2013.01); *F15B 1/02* (2013.01); *F15B 2201/40* (2013.01); *F15B 2211/20507* (2013.01); *F15B 2211/20576* (2013.01); *F15B 2211/212* (2013.01)

(58) Field of Classification Search

CPC .... F15B 1/00; F15B 1/02; F15B 1/024; F15B 1/027; F15B 1/0275

USPC ..... 60/416

See application file for complete search history.

(56) References Cited

U.S. PATENT DOCUMENTS

| | | | | |
|---|---|---|---|---|
| 2008/0185046 | A1* | 8/2008 | Springett | E21B 33/0355 137/14 |
| 2011/0114329 | A1* | 5/2011 | Emecheta | E21B 33/0355 166/350 |
| 2015/0104328 | A1* | 4/2015 | Babbitt | F04B 17/03 417/2 |

* cited by examiner

*Primary Examiner* — Thomas E. Lazo
*Assistant Examiner* — Daniel Collins
(74) *Attorney, Agent, or Firm* — Todd Jennings

(57) ABSTRACT

A redundant accumulator system for delivery of pressurized hydraulic fluid to blowout preventers ("BOPs") and other well equipment during coiled tubing and wirelining operations that has sufficient reserve fluid capacity to simultaneously operate a plurality of BOPs and other well equipment and to hold a plurality of BOPs closed in the event of a hydraulic fluid leak, and is appropriately sized for use aboard an offshore vessel or platform or for use in close proximity to an inland wellhead. The accumulator system includes a hydraulic fluid capacity that is at least twice the capacity of the accumulators, a plurality of pneumatically operated pumps in parallel, each having the maximum inlets and outlets for their size to maximize the charging capacity of the accumulator system and allow the system to be charged to operational pressure in less than thirty minutes.

12 Claims, 4 Drawing Sheets

ACCUMULATOR SYSTEM FOR USE WITH COILED TUBING AND WIRELINING OPERATIONS

CROSS-REFERENCES TO RELATED APPLICATIONS

This application claims the priority and the benefit of U.S. Provisional Application No. 62/125,487, filed Jan. 23, 2015, entitled "Accumulator System for Use With Coiled Tubing and Wirelining Operations."

STATEMENT REGARDING FEDERALLY SPONSORED RESEARCH

Not Applicable.

NAMES OF PARTIES TO JOINT RESEARCH AGREEMENT

Not Applicable.

REFERENCE TO A SEQUENCE LISTING

Not Applicable.

STATEMENT REGARDING PRIOR DISCLOSURES BY THE INVENTOR

Not Applicable.

BACKGROUND OF THE INVENTION (1) Field of Invention

The present invention relates generally to an accumulator system for delivery of pressurized hydraulic fluid pressure to blowout preventers (BOPs) and other well equipment during coiled tubing and wirelining operations supporting mineral exploration and production. In drilling and/or work over operations, after a well has been drilled, a cabling apparatus, referred to as wireline, is used to lower various equipment and tools downhole to monitor the conditions in the well and assist in well servicing, intervention, pipe recovery and other operations. A very long metal pipe, referred to as coiled tubing, is also used for well interventions, and is often used to carry out operations similar to wirelining. During downhole operations, it is sometimes desirable to create a seal about the wireline or coiled tubing to allow for maintenance or to mitigate emergency situations. A mechanical apparatus, referred to as a blowout preventer (BOP), is used to seal the wireline or coiled tubing and prevent a blowout. A BOP requires a significant power source, and is typically operated hydraulically to quickly seal the wireline or coiled tubing and close off the well. Hydraulic fluid power is supplied to the BOP by fluidly coupling the BOP to an accumulator system that is capable of delivering the hydraulic fluid power necessary to operate the BOP. In offshore settings, such accumulator systems are usually staged on a tension-leg platform, production module, stationary platform, inland barge, jack up boat, lift boat or other elevated vessel. In workover operations, such accumulator systems are staged as close to the well head as practical.

Presently, coiled tubing and wireline blowout preventers are operated by accumulator systems that generally operate with less hydraulic fluid than the capacity of the accumulators. This problem stems from the need for such accumulator systems to have a small size or footprint for operation from a tension-leg platform, production module, stationary platform, inland barge, pro, jack up boat, lift boat or other elevated vessel. Likewise, workover operations require an accumulator system with a small size or footprint for use in close proximity to the well head. Such accumulator systems pose several problems. First, any leak or other casualty resulting in the egress of hydraulic fluid from the accumulator system renders the system inoperable. In such a scenario, the operator must either connect a different accumulator system to the BOP or attempt to correct the leak or other condition that resulted in the egress of hydraulic fluid from the system. Both alternatives expend considerable time and may result in the failure to mitigate an emergency situation. Second, a leak or other casualty resulting in the spill of hydraulic fluid that occurs after the closing of a BOP may render the accumulator system unable to hold the BOP in the closed position. Third, a limited hydraulic fluid capacity limits the number of BOPs or other well equipment that can be simultaneously operated by the accumulator system. Thus, exploration and production, activities that involve the simultaneous operation of several BOPs or other well equipment often require the use of more than one accumulator system.

Additionally, accumulator systems for use in wirelining and coiled tubing operations offer little in the way of redundancy, often comprising one electrically or pneumatically operated pump and a hand pump. This problem also stems from the need for such accumulators to have a small size or footprint for operation from a jack up boat, lift boat or other elevated vessel. The hand pump is used in the event that the electrically or pneumatically operated pump is inoperable. Pressurizing a hydraulic system for use in well operations with a hand pump is time consuming and impractical. Moreover, a single pump coupled with a hydraulic fluid capacity that is less than the capacity of the accumulators results in an accumulator system that is slow to charge to a pressure necessary to operate the BOP.

(2) Background Art

There are several accumulator systems and other systems for providing pressurized hydraulic fluid for the operation of subsea well equipment. Examples of such systems include, but are not limited to, U.S. Pat. App. Nos. US2012/0279720, US2015/9004175, and US2013/8602109. While such systems fulfill their particular purposes, they do not address the need for a redundant accumulator system with a small footprint that can quickly be charged to operational pressure and that has sufficient hydraulic fluid capacity to overcome hydraulic fluid leaks and operate a plurality of BOPS or other well equipment.

SUMMARY OF INVENTION

Accordingly, it remained for the present inventor to provide an accumulator system with sufficient reserve fluid capacity to simultaneously operate a plurality of BOPs and other well equipment, and to operate and hold a BOP or plurality of BOPs closed in the event of a leak or other casualty resulting in the spill of hydraulic fluid. It also remained for the present inventor to provide a redundant accumulator system equipped with an additional means of charging the system without resorting to the use of a hand pump. It further remained for the present inventor to provide an accumulator system with the aforementioned capacity and redundant charging capabilities that was sized appropriately for use aboard an offshore vessel or platform or for use in close proximity to an inland well head.

In particular embodiments of the invention, the object of the invention may be generally accomplished by mounting a bank of pressure vessels used to store hydraulic fluid charged with a non-reactive or inert gas, known as accumulators, in a mounting apparatus, or accumulator skid, fluidly coupling the bank of accumulators to a charging conduit fluidly coupled to a redundant charging means mounted within the mounting apparatus, fluidly coupling the redundant charging means to a hydraulic fluid reservoir having a hydraulic fluid capacity greater than the capacity of the accumulator bank, and fluidly coupling the charging conduit to a delivery means to deliver pressurized hydraulic fluid to a plurality of BOPs or other well equipment.

Such an accumulator bank may, for example, be comprised of a plurality of accumulators of comparable capacity capable of withstanding a pressure greater than the pressure necessary to operate a plurality of BOPs and/or other well equipment arranged in parallel with an inlet port for pressurization with an inert gas, such as nitrogen, and a charging port for permitting entry of hydraulic fluid into the accumulators to elevate the pressure of the accumulator system. Some embodiments of the invention may include two or more accumulator banks as required to provide the hydraulic fluid power necessary to operate a greater plurality of BOPs or other well equipment. The hydraulic fluid reservoir may be comprised of a tank mounted within the mounting apparatus having a capacity greater than the capacity of the accumulator banks and configured to minimize the footprint of the accumulator system. In some embodiments, the reservoir may be mounted vertically to minimize the footprint of the mounting apparatus.

Also by way of illustration, the redundant charging means may be comprised of two pneumatically-operated pumps arranged in parallel. Some embodiments may include a charging means comprising more than two pneumatically-operated pumps or comprised of pumps operated by other means, including but not limited to electricity or gas. In some embodiments, the pumps are capable of being operated simultaneously, in addition to individually, so to minimize the time required to charge the accumulator system to the pressure necessary to operate a plurality of BOPs or other well equipment. Additionally, some embodiments include pumps sized to minimize the footprint of the accumulator system that have the maximum allowable inlets and outlets for their size to maximize the charging capacity of the accumulator system. Moreover, some embodiments may incorporate a hand pump into the redundant charging means as an additional layer of redundancy.

DETAILED DESCRIPTION

Figure 1:
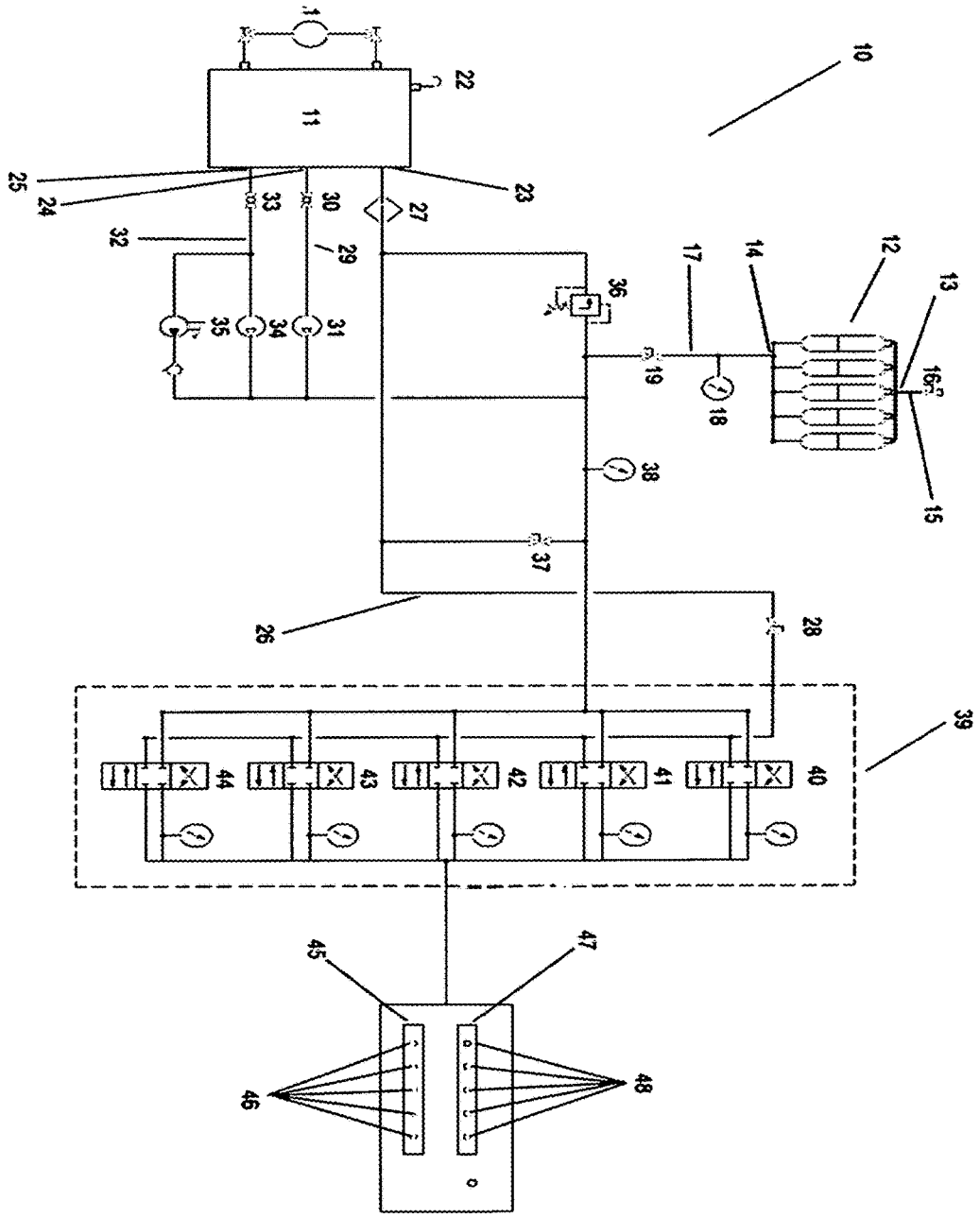
FIG. 1 is a schematic of an accumulator system that embodies the objects of the present invention.
Figure 2:
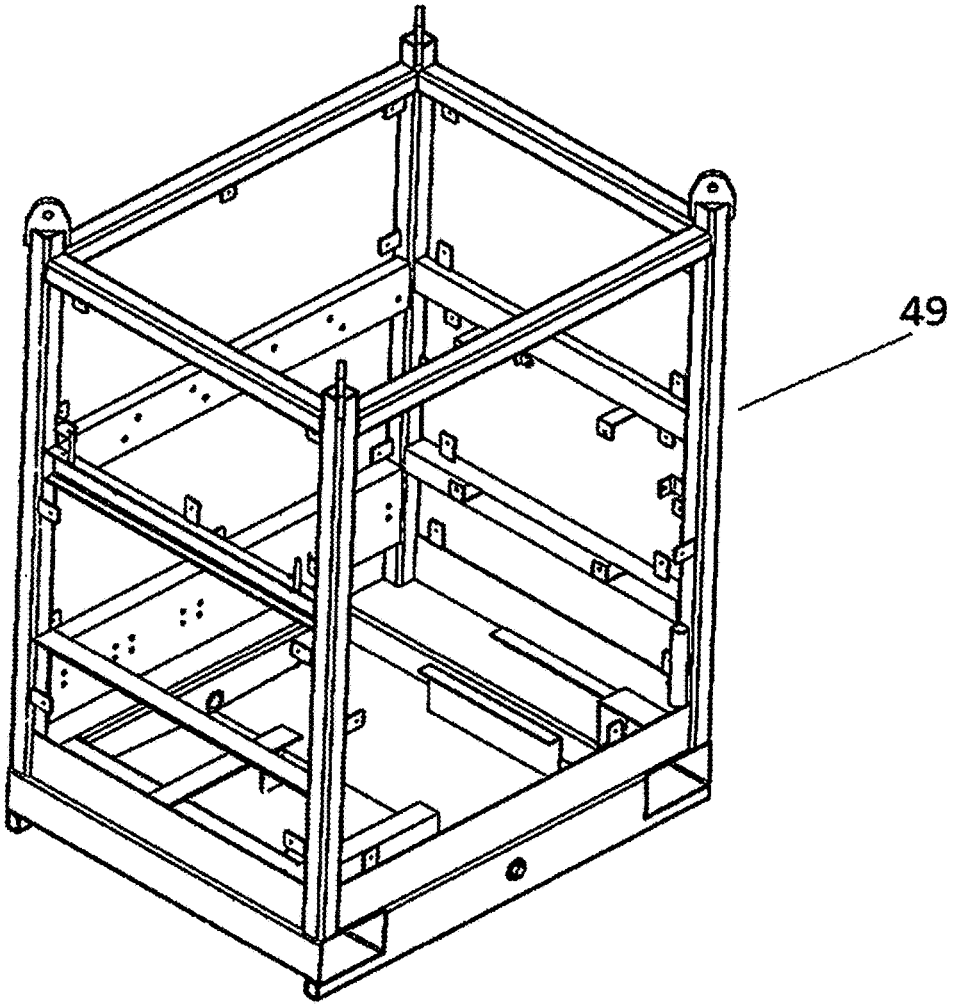
FIG. 2 is perspective view of a mounting apparatus

In accordance with the present invention, FIG. 1 provides a hydraulic schematic of one particular embodiment of an accumulator system capable of operating a plurality of BOPs or other well equipment having a hydraulic fluid capacity greater then the capacity of the accumulator bank, a redundant charging means, and a footprint small enough for practical use on a tension-leg platform, production module, stationary platform, inland barge, jack up boat, lift boat or other elevated vessel, or in close proximity to an inland well head. The accumulator system 10 generally operates to draw hydraulic fluid from a fluid reservoir 11 to compress a pressurized, inert gas in an accumulator bank 12 comprising a plurality of accumulators of comparable capacity and deliver pressurized hydraulic fluid to a plurality of BOPs or other well equipment. The entire system is mounted within a mounting apparatus 49 (FIG. 2).

Figure 3:
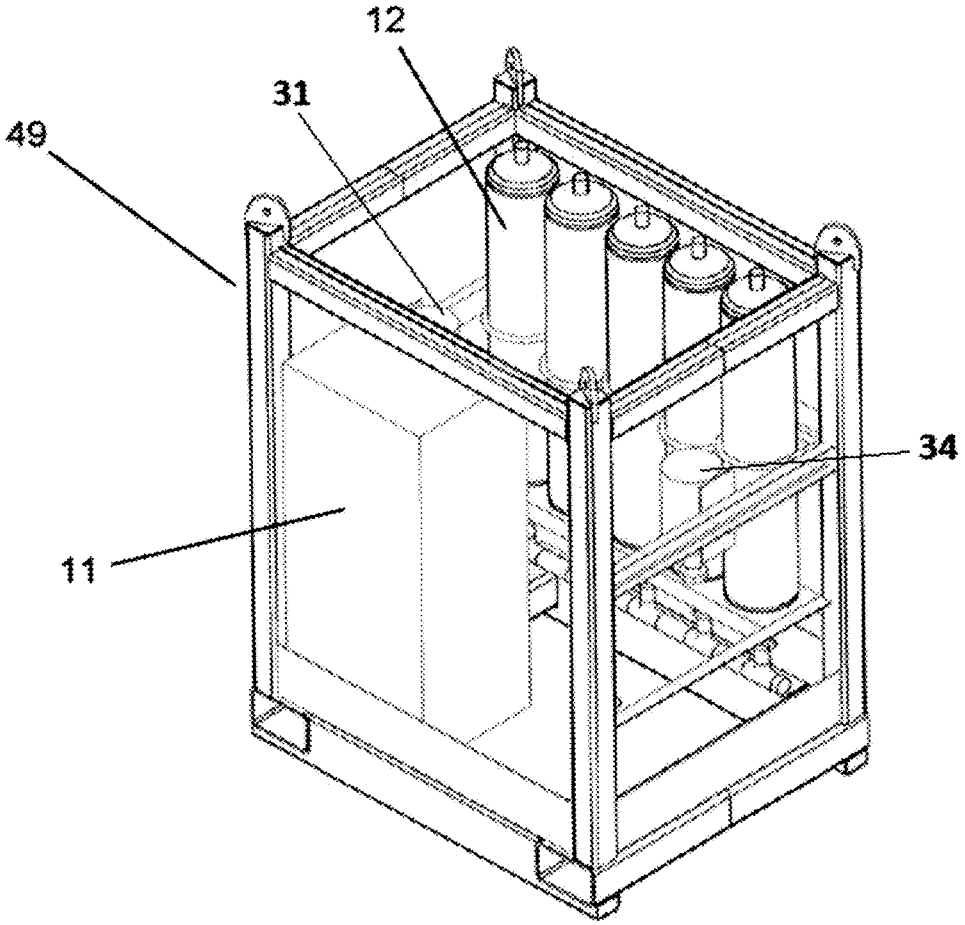
FIG. 3 is a perspective view of a mounting apparatus with a vertically mounted fluid reservoir and accumulator bank.

The accumulator bank 12 in this particular embodiment is comprised of five, ten-gallon accumulators mounted vertically in the mounting apparatus 49 (FIG. 3). However, an accumulator system embodying the principles of the invention can have any desired number of accumulator banks comprising any desired number of accumulators of varying capacities as required to operate a lesser or greater plurality of BOPs or other well equipment. However, limiting the size or footprint of the accumulator system 10 may become an issue as more accumulator banks are incorporated. The accumulator bank 12 has an inlet port 13 to allow the accumulator bank 12 to be pressurized with an inert gas, such as nitrogen, and a charging port 14 for permitting the inert gas in the accumulator bank 12 to interact with the charged hydraulic fluid. The inlet port is coupled to a pressurization conduit 15 having a pressurization isolation means 16, embodied here as an isolation valve, for isolating the inlet port 13 of the accumulator bank 12 from the pressurization conduit 15. The pressurization isolation means 16 may be comprised of any mechanical device suited for regulating the flow of an inert gas, such as a needle valve.

The charging port 14 is fluidly coupled to a charging conduit 17 having a pressure-monitoring means 18 for monitoring the pressure of the accumulator bank 12, and an accumulator isolation means 19 for isolating the accumulator bank 12. In this particular embodiment, the pressure-monitoring means 18 comprises a pressure gauge and the accumulator isolation means 19 comprises an isolation valve. As stated above, other embodiments of the invention may have more than one accumulator bank, in which case each accumulator bank would include its own inlet port and charging port, pressure-monitoring means and accumulator isolation means. In such embodiments, each accumulator bank would be fluidly coupled to a single charging conduit.

The fluid reservoir 11 is embodied here as a tank having a level-monitoring means or gauge 21 for monitoring the amount of fluid in the fluid reservoir 11, a pressure-relief means 22 to protect the reservoir from overpressure situations, a return port 23, a first supply port 24 and an auxiliary supply port 25. In this particular embodiment, the capacity of the fluid reservoir 11 is two times the capacity of the accumulator bank 12, or 100 gallons. In embodiments having more than one accumulator bank, the capacity of the reservoir is at least two times the combined capacity of the accumulator banks. Here, the fluid reservoir 11 is mounted vertically within the mounting apparatus 49 (FIG. 3) and is dimensioned to provide at least twice the capacity of the accumulator bank 12 while minimizing the footprint of the accumulator system 10. Specifically, the fluid reservoir 11 in this particular embodiment is 52 inches in height, 24 inches in depth and while minimizing the footprint of the accumulator system 10. Other embodiments of the invention may comprise a fluid reservoir that is configured differently from the disclosed embodiment to accommodate additional accumulator banks. In such embodiments, the fluid reservoir is likewise configured to provide twice the capacity of the accumulator banks while minimizing the footprint of the accumulator system. The fluid reservoir 11 may be composed of any material suited for the storage of hydrocarbons and capable of withstanding a pressure greater than the pressure required to operate a plurality of BOPs. In this particular embodiment, the fluid reservoir 11 is comprised of stainless steel and can withstand a pressure in excess of 3,500 pounds.

The return port 23 of the fluid reservoir 11 is fluidly coupled to a return conduit 26 having a filtering means 27 for removing particulate and other debris from the hydraulic fluid before the fluid returns to the fluid reservoir 11, and a return isolation means 28, embodied here as an isolation valve, for isolating the fluid reservoir 11 from the return conduit 26. The return conduit 26 may be composed of any material suited for the storage of hydrocarbons and capable of withstanding a pressure greater than the pressure required to operate a plurality of BOPs. In this particular embodiment, the return conduit 26 is comprised of stainless steel and can withstand a pressure in excess of 3,500 pounds.

The first supply port 24 is fluidly coupled to a supply conduit 29 having an isolation means 30 for isolating the fluid reservoir 11 from the supply conduit 29. Here, the isolation means 30 is embodied as a ball valve. On the other side of the isolation means 30, the supply conduit 29 has a pumping means, said pumping means comprising a first charging pump 31. Similarly, the auxiliary supply port 25 is fluidly coupled to an auxiliary supply conduit 32 having an auxiliary isolation means 33 for the isolating the fluid reservoir 11 from the auxiliary supply conduit 32. The auxiliary isolation means 33 is likewise embodied here as a ball valve. On the other side of the auxiliary isolation means 33, the auxiliary supply conduit 32 has an auxiliary pumping means, said auxiliary pumping means comprising an auxiliary charging pump 34 and a hand pump 35 in parallel. The auxiliary charging pump 34 is operated in the event that the first charging pump 31 is inoperable, and the hand pump 35 is operated by hand in the event that the first charging pump 31 and auxiliary charging pump 34 are inoperable. The first charging pump 31 and auxiliary charging pump 34 may be operated independently or concurrently. In this particular embodiment, the first charging pump 31 and auxiliary charging pump 34 are pneumatically operated; however, other embodiments of the invention have a pumping means comprising a first charging pump and auxiliary charging pump that are operated by other means, including but not limited to electricity or gas. Further, pneumatically operated pumps are safer and do not pose the possibility of a combustion event. Additionally, some embodiments of the invention include a charging means that is comprised of more than one auxiliary charging pump. Such embodiments may be comprised of a fluid reservoir having a plurality of supply ports and supply conduits equal to the number of charging pumps. Further, such embodiments may include a hand pump operating in parallel with one of the charging pumps.

The first charging pump 31 and auxiliary charging pump 34 are configured to provide the charging capacity necessary to quickly charge the accumulator system 10 to a pressure necessary to operate a plurality of BOPs or other well equipment while minimizing the footprint of the accumulator system 10. Specifically, the inventor determined that utilizing pumps having the largest inlet and outlet for their size would minimize the footprint of the accumulator system without degrading its charging capabilities. A large inlet draws more hydraulic fluid from the fluid reservoir 11 and a large outlet allows a greater flow of hydraulic fluid to the accumulator bank 12. In this particular embodiment, the first charging pump 31 and auxiliary charging pumps 34 have a charging capacity of 4-5 gallons per minute, an inlet 1-inch in diameter and an outlet 0.5-inches in diameter. Other embodiments of the invention may incorporate pumps of varying capacities and sizes to accommodate a lesser or greater plurality of accumulator banks and hydraulic reserve fluid capacity. In this particular embodiment, the concurrent use of the first charging pump 31 and auxiliary charging pump 35 permits the accumulator system 10 to be charged to required pressure to operate a plurality of BOPs or other well equipment in less than 18 minutes.

On the other side of the first charging pump 31 and auxiliary charging pump 34 respectively, the supply conduit 29 and auxiliary supply conduit 32 are fluidly coupled to the charging conduit 17, which includes a pressure relief means 36, embodied here as a relief valve, for protecting the accumulator system 10 from over-pressurization, a dumping means 37, embodied here as a dump valve, for directing fluid from the charging conduit 17 to the return conduit 26 and into the fluid reservoir 11, and a fluid pressure monitoring means 38, embodied here as a pressure gauge, for monitoring hydraulic fluid pressure. As stated above, the charging conduit 17 is fluidly coupled to the charging port 14 of the accumulator bank 12. The charging conduit 17 is also coupled to a fluid control means 39 comprising an apparatus or plurality of apparatuses capable of directing hydraulic fluid to a plurality of BOPs or other well equipment and back into the return conduit 26. In this particular embodiment, the fluid control means 39 is comprised of five directional control valves having a closed, open and neutral position.

Specifically, this particular embodiment incorporates a first directional control valve 40, a second directional control valve 41, a third directional control valve 42, a fourth directional control valve 43, and a fifth directional control valve 44. By way of example, the first directional control valve 40 may be operated in the close, open or neutral position. In the neutral position, no hydraulic fluid passes through the first directional control valve 40. In the closed position, pressurized hydraulic fluid is delivered to the inlet of a BOP or other well equipment. In the open position, pressurized hydraulic fluid is drawn from the outlet of the BOP or other well equipment into the return conduit 26. The four remaining directional control valves operate in a similar fashion to direct the supply and return of hydraulic fluid. Embodiments of the invention capable of simultaneously operating more than five BOPs or other well equipment may comprise a fluid control means 39 having a greater plurality of directional control valves or other apparatuses capable of directing hydraulic fluid to the BOPs or other well equipment and back into the return conduit 26. For example, an accumulator system that meets the object of the present invention and is capable of supplying pressurized hydraulic fluid to ten BOPs may have a fluid control means comprising ten directional control valves.

The fluid control means 39 is fluidly coupled to a delivery means 45 that may be coupled to a plurality of BOPs or other well equipment for delivery of pressurized hydraulic fluid. The delivery means 45 is comprised of a plurality of delivery flowlines in equal number to the number of apparatuses comprising the fluid control means 39. In this particular embodiment, the delivery means is comprised of five delivery flowlines 46 that connect each directional control valve to the inlet side of a particular BOP or other well equipment. The fluid control means 39 is further fluidly coupled to a return means 47 that connects the outlets of a plurality of BOPs or other well equipment to the fluid control means 39.

In this particular embodiment, the return means 39 is comprised of five return flowlines 48 that connect each directional control valve to the outlet side of a particular BOP or other well equipment. Embodiments having a fluid control means comprising of a greater plurality of directional control valves or other apparatuses may have a delivery means and return means comprised of a greater plurality of delivery flowlines and return flowlines respectively. For example, an accumulator system that meets the object of the present invention and is capable of supplying pressurized hydraulic fluid to ten BOPs may have a delivery means comprising ten delivery flowlines. The delivery means 45 and return means 47 may be comprised of any material capable of withstanding the pressure required to operate the BOPs, such as a rubber hose. Some embodiments may include a delivery means and return means comprised of a fire-retardant material to allow an operator to operate the accumulator system and close a BOP or plurality of BOPs before vacating the area in the event a combustion event should occur in and around the well head. In this particular embodiment, the delivery means 45 and return means 47 are comprised of a hose designed to withstand highly elevated temperatures for a period time greater than the period of time it takes the accumulator system to operate a BOP or plurality of BOPs.

In operation, the accumulator bank 12 is pressurized, or pre-charged, by passing an inert gas, such as nitrogen, through the pressurize on conduit 15 and into the inlet port 13 of the accumulator bank 12. Once pressurized, the pressurization isolation means 16 is secured to prevent the depressurization of the accumulator bank 12. Hydraulic fluid is then drawn out of the fluid reservoir 11, through the supply conduit 29 and into the charging conduit 17 by activating the first charging pump 31. If the first charging pump 31 is inoperable, fluid may be drawn out of the fluid reservoir 11, through the auxiliary supply conduit 32 and into the charging conduit 17 by activating the auxiliary charging pump 34 or the hand pump 35 should the auxiliary charging pump 34 also be inoperable. If both the first charging pump 31 and auxiliary charging pump 34 are operable, fluid may be drawn out of the fluid reservoir 11 through the supply conduit 29 and auxiliary supply conduit 32 and into the charging conduit 17 at a faster rate by simultaneously activating the first charging pump 31 and auxiliary charging pump 34. In this particular embodiment, simultaneously activating the first charging pump 31 and auxiliary charging pump 34 will charge the accumulator system 10 to the pressure required to operate five BOPs or other well equipment in approximately 18 minutes.

As the hydraulic fluid is drawn into the charging conduit 17, it enters the charging port 14 of the accumulator bank 12, and compresses the pressurized inert gas in the accumulator bank 12, thus elevating the pressure of the hydraulic fluid and accumulator system 10. Hydraulic fluid is drawn into the charging conduit 17 and charging port 14 by the first charging pump 31 and/or auxiliary charging pump 34 until the necessary pressure is reached within the accumulator system 10, and the first charging pump 31 and/or auxiliary charging pump 34 are secured. While charging the accumulator system 10, the hydraulic fluid pressure may be monitored via the fluid pressure monitoring means 38.

Figure 4:
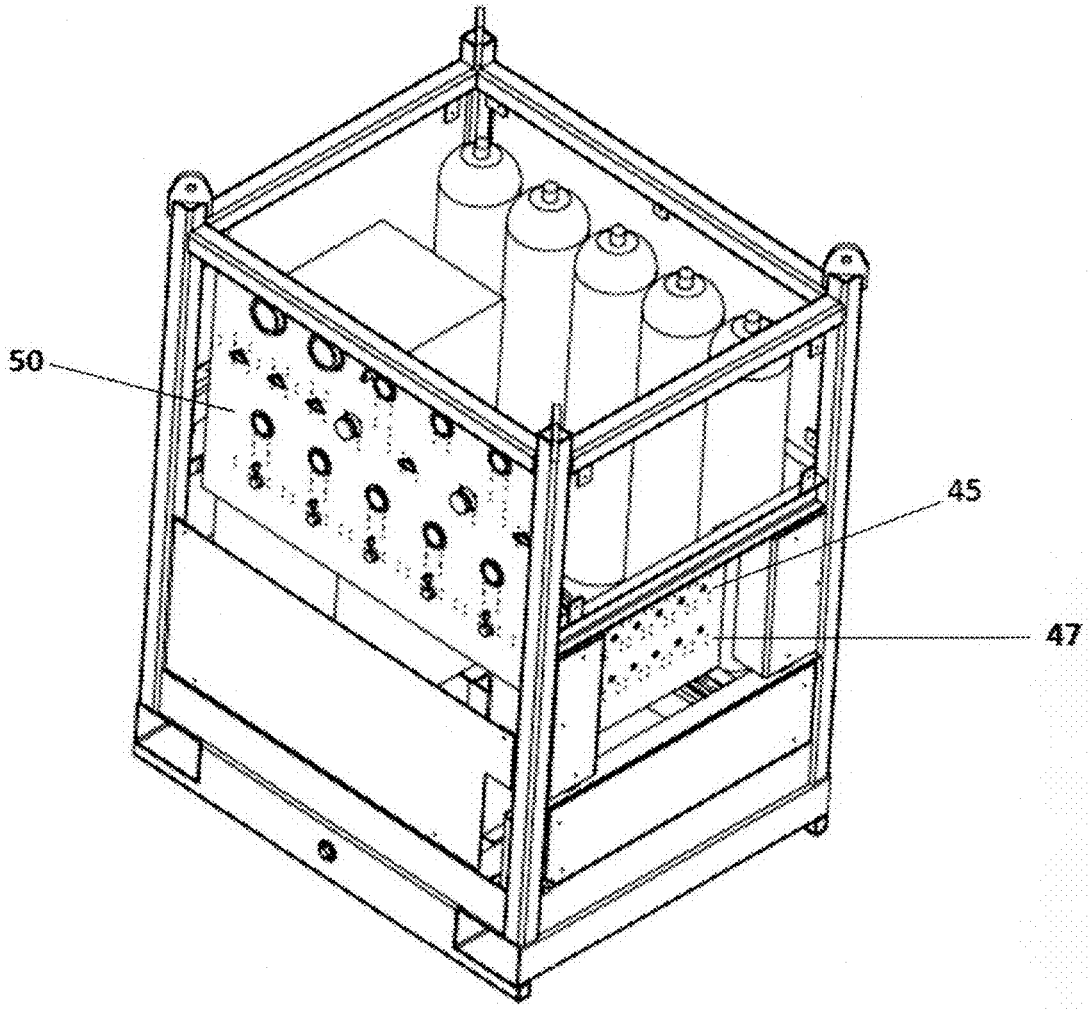
FIG. 4 is a perspective view of a mounting apparatus with a vertically mounted fluid reservoir and accumulator bank, and a mounted control panel.

Once the desired hydraulic fluid pressure is achieved, and the first charging pump 31 and/or auxiliary charging pump 34 are deactivated, the pressurized hydraulic fluid can be delivered to a BOP or plurality of BOPs or other well equipment by placing the appropriate directional control valve(s) in the "closed" position and allowing pressurized hydraulic fluid to pass through the fluid control means 39, enter the delivery means 45 and be delivered to the inlet side of a plurality of BOPs or other well equipment. When desired, the BOPs may be opened by placing the appropriate directional control valve(s) in the "open position," allowing the hydraulic fluid to pass from the outlet side of the BOP or other well equipment through the return means 47, fluid control means 39, return conduit 26, filtering means 27 and into the fluid reservoir 11. All accumulator systems embodying the foregoing objects of the invention are capable of closing, opening, and again closing a plurality of BOPs on a single charge. The operation of the accumulator system's valves and pumps is achieved through a control panel 50 (FIG. 4).

The invention claimed is:

1. A hydraulic accumulator system for subsea and inland drilling systems for the purpose of providing a redundant and sufficient hydraulic fluid capacity to operate a plurality of BOPs or other subsea and inland well equipment, comprising:

a mounting apparatus;

an accumulator bank mounted in the mounting apparatus and fluidly coupled to a charging conduit in the mounting apparatus;

a first, second and third hydraulic fluid pump mounted in the mounting apparatus in parallel and fluidly coupled to the charging conduit for pumping hydraulic fluid into the charging conduit and accumulator bank, wherein the first and second pumps are pneumatically operated, and the third pump is operated by hand;

a hydraulic fluid reservoir mounted in the mounting apparatus and fluidly coupled to the redundant charging means, said hydraulic fluid reservoir having a hydraulic fluid capacity greater than the capacity of the accumulator bank;

a hydraulic fluid control means mounted in the mounting apparatus and fluidly coupled to the charging conduit for directing hydraulic fluid to the BOPs or other well equipment, and allowing for hydraulic fluid to return to the hydraulic fluid reservoir;

a delivery means fluidly coupled to the hydraulic fluid control means for delivering hydraulic fluid power to a plurality of BOPs or other well equipment;

a return means fluidly coupled to the hydraulic fluid control means for allowing hydraulic fluid from the BOPs or other well equipment to the hydraulic fluid reservoir; and a control panel.

2. A hydraulic accumulator system as in claim 1 wherein the first and second hydraulic fluid pumps have an inlet port 1-inch in diameter and an outlet port 0.5 inches in diameter.

3. A hydraulic accumulator system as in claim 1 wherein the first and second hydraulic fluid pumps have a capacity sufficient to charge the system to pressure necessary to operate a plurality of BOPs or other well equipment within 30 minutes.

4. A hydraulic accumulator system as in claim 1 wherein the first and second hydraulic fluid pumps have a charging capacity of 4-5 gallons per minute.

5. A hydraulic accumulator system as in claim 1 wherein the hydraulic fluid reservoir comprises a hydraulic fluid tank having a level-monitoring means, a pressure-relief means, a return port, a first supply port and a second supply port fluidly coupled to the redundant charging means, and a hydraulic fluid capacity that is twice the capacity of the accumulator bank.

6. A hydraulic accumulators as in claim 5 wherein the hydraulic fluid reservoir has a hydraulic fluid capacity of 100 gallons.

7. A hydraulic accumulator system as in claim 5 wherein the hydraulic fluid reservoir is fifty-two inches in height, twenty-four inches in depth, and nineteen inches in width.

8. A hydraulic accumulator system as in claim 5 wherein the hydraulic fluid reservoir is comprised of a material suitable for the storage of hydrocarbons and capable of withstanding a pressure greater than the pressure required to operate a plurality of BOPS.

9. A hydraulic accumulator system as in claim 5 wherein the hydraulic fluid reservoir is comprised of stainless steel.

10. A hydraulic accumulator system as in claim 1 wherein the delivery means and return means are each comprised of five flowlines composed of rubber capable of withstanding the pressure required to operates the BOPs or other well equipment.

11. A hydraulic accumulator system as in claim 10 wherein the Bowlines are composed of a material capable of withstanding highly elevated temperatures.

12. A hydraulic accumulator system as in claim 1 wherein the mounting apparatus is stand-alone and small enough for use aboard a tension-leg platform, production module, stationary platform, inland barge, jack up boat, lift boat or other elevated vessel.

* * * * *